US005711030A

United States Patent [19]

Anderson et al.

[11] Patent Number: 5,711,030

[45] Date of Patent: Jan. 27, 1998

[54] COLLAR SHIELD

[76] Inventors: Carol Anderson; Norman Brisco, both of 10301 Deerfield Dr., New Orleans, La. 70127

[21] Appl. No.: 758,708

[22] Filed: Dec. 3, 1996

[51] Int. Cl.[6] ..... A41D 27/16

[52] U.S. Cl. ..... 2/60; 2/46; 2/139; 2/50

[58] Field of Search ..... 2/53, 54, 55, 56, 2/57, 60, 132, 135, 139, 174, 400, 406, 181, 181.6, 182.3, 50, 46, 131, 129; 604/385.1, 385.2

[56] References Cited

U.S. PATENT DOCUMENTS

| | | | |
|---|---|---|---|
| 2,116,685 | 5/1938 | Nicolet | 2/60 |
| 2,637,034 | 5/1953 | Smith | 2/60 |
| 2,669,720 | 2/1954 | Vanderkerck | 2/55 |
| 3,022,514 | 2/1962 | Kaiser | 2/60 |
| 3,346,878 | 10/1967 | Morris | 2/55 |
| 4,008,494 | 2/1977 | Hicks | 2/60 |
| 4,653,119 | 3/1987 | Kaiser | 2/60 |
| 4,747,162 | 5/1988 | Yanagihara | 2/53 |
| 4,856,111 | 8/1989 | Sholes | 2/56 |

FOREIGN PATENT DOCUMENTS

| | | | |
|---|---|---|---|
| 1222354 | 6/1987 | Canada | 2/60 |

*Primary Examiner*—Jeanette E. Chapman
*Attorney, Agent, or Firm*—Joseph N. Breaux

[57] ABSTRACT

A collar shield including an outer cloth section having the perimeter area of an inwardly facing side thereof coated with a heat activated adhesive layer, an inner section of non-woven fabric that is coated on a collar facing side with a layer of whitening agent, and a central barrier strip formed from a flexible, moisture impermeable material positioned between the outer cloth section and the inner section of nonwoven fabric in a manner such that the layer of whitening agent is oriented away from the barrier strip. The outer cloth section, the inner section of non-woven fabric, and the central barrier strip are secured together with an adhesive to form the collar shield. The inner section nonwoven fabric and the central barrier strip are sized such that the heat activated adhesive layer extends past the perimeter edges of the inner section of nonwoven fabric and the central barrier strip. The whitening agent preferably includes a proteolytic enzyme, and more preferably is a paste including forty-five percent sursactants, forty-five percent propylene glycol, and three percent proteolytic enzyme.

17 Claims, 1 Drawing Sheet

COLLAR SHIELD

TECHNICAL FIELD

The present invention relates to shields for the inside surface of a shirt collar and more particularly to a disposable collar shield including an outer cloth section having the perimeter area thereof coated with a layer of heat activated adhesive, an inner section of non-woven fabric coated on one side with a layer of whitening agent, and a central barrier strip formed from a flexible moisture impermeable sheet positioned between the outer cloth section and the inner section of nonwoven fabric in a manner such that the layer of whitening agent oriented away from the central barrier strip. The inner section of nonwoven fabric and the central barrier strip are sized such that the heat activated adhesive layer extends past the perimeter edges of the inner section of nonwoven fabric and the central barrier strip. In use, the collar shield is secured to the collar of a shirt by placing the layer of whitening agent against the inside surface of the shirt collar and then applying heat, such as with an iron, to activate the layer of heat activated adhesive and bond the collar shield to the collar. As the shirt is worn, whitening agent from the layer of whiting agent is forced into the inside surface of the shirt collar preventing the formation of stains and remaining during laundering after the collar shield has been removed. The collar shield is removed by grasping an edge of the outer cloth section and then pulling the collar shield free of the shirt collar prior to laundering.

BACKGROUND OF THE INVENTION

Shirt collars often develop unsightly rings and stains through wear. These rings can be difficult to remove. It would be a benefit, therefore, to have a collar shield that could be placed onto the collar that would shield the collar material from contact with the skin of the wearer. Although shielding the collar material from the skin of the wearer can reduce the occurrence and intensity of collar rings and stains, because the collar material is porous it is difficult to totally eliminate perspiration and the like from contacting the collar material. It would be a benefit, therefore to have a collar shield that included a stain prevention and/or stain removal agent that would transfer into the collar material of the shirt during wear that would minimize and help remove collar rings and stains during normal laundering.

SUMMARY OF THE INVENTION

It is thus an object of the invention to provide a collar shield that can be placed onto the collar that shields the collar material from contact with the skin of the wearer.

It is a further object of the invention to provide a collar shield that includes a whitening agent that transfers into the collar of the shirt during wear.

It is a still further object of the invention to provide a collar shield that accomplishes all or some of the above objects in combination.

Accordingly, a collar shield is provided. The collar shield includes an outer cloth section having the perimeter area of an inwardly facing side thereof coated with a heat activated adhesive layer, an inner section of non-woven fabric that is coated on a collar facing side with a layer of whitening agent, and a central barrier strip formed from a flexible, moisture impermeable material positioned between the outer cloth section and the inner section of nonwoven fabric in a manner such that the layer of whitening agent is oriented away from the barrier strip. The outer cloth section, the inner section of non-woven fabric, and the central barrier strip are secured together with an adhesive to form the collar shield. The inner section nonwoven fabric and the central barrier strip are sized such that the heat activated adhesive layer extends past the perimeter edges of the inner section of nonwoven fabric and the central barrier strip. The term "whitening agent" is used herein to mean a chemical preparation that reduces the occurrence of staining or acts to remove the staining during laundering of the collar material. The whitening agent preferably includes a proteolytic enzyme, and more preferably is a paste including forty-five percent sursactants, forty-five percent propylene glycol, and three percent proteolytic enzyme.

In use, the collar shield is secured to the collar of a shirt by placing the layer of whitening agent strip against the inside surface of the shirt collar and then applying heat, such as with an iron, to activate the heat activated adhesive coating the perimeter are of the cloth strip and bond the collar shield to the collar. As the shirt is worn, whitening agent from the layer of whiting agent is forced into the inside surface of the shirt collar preventing the formation of stains and remaining during laundering after the collar shield has been removed to assist in removing the stain during washing. The collar shield is removed by grasping an edge of the cloth strip and pulling the collar shield free of the shirt collar prior to laundering.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
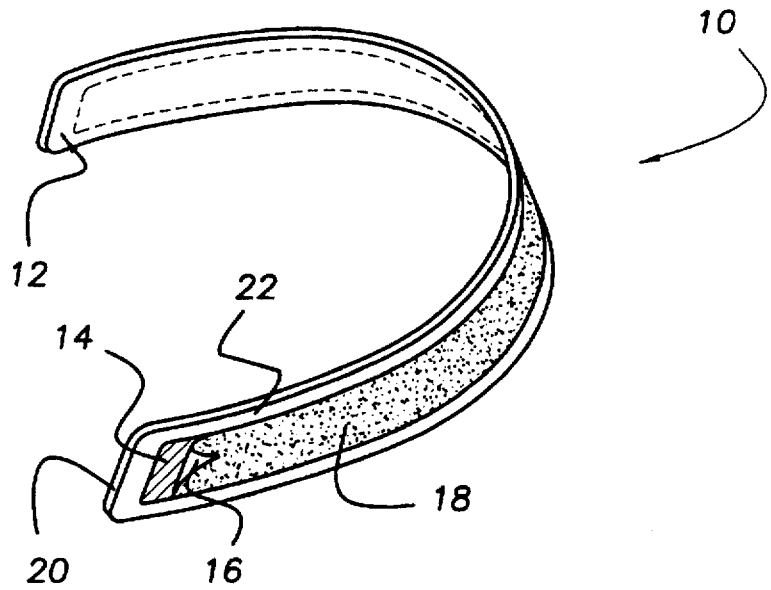
FIG. 1 is a perspective view of an exemplary embodiment of the collar shield of the present invention showing the outer section of cloth including the perimeter area coated with the heat activated adhesive, the central barrier strip, and the inner section of non-woven fabric including the coating of whitening agent.

FIG. 1 shows an exemplary embodiment of the collar shield of the present invention, generally designated by the numeral 10. Collar shield 10 includes an outer cloth section, generally designated 12, a central barrier strip 14, an inner section of non-woven fabric, generally designated 16 (shown partially peeled away to reveal central barrier strip 14), and a layer of whitening agent 18.

Outer cloth section 12 is constructed from a convention woven fabric material that is preferably selected to match the shirt collar material of the shirt with which collar shield 10 is to be used. For instance, if a white cotton broadcloth shirt is to be worn, outer cloth section 12 would be constructed from a section of white cotton broadcloth. An inwardly facing side surface 20 of outer cloth section 12 is coated along a perimeter area thereof with a heat activated adhesive layer 22.

Figure 2:
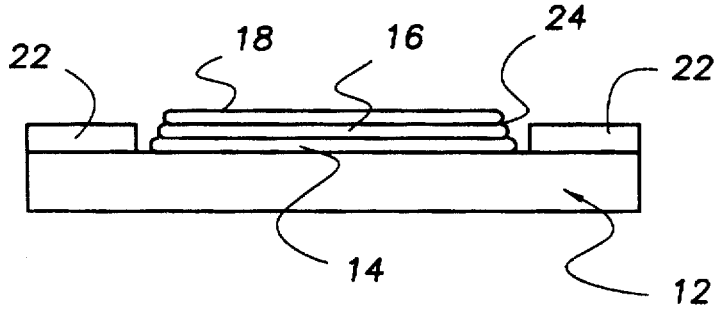
FIG. 2 is a end plan view of the exemplary collar shield of FIG. 1 showing the outer section of cloth, the perimeter area coated with the heat activated adhesive, the central barrier strip, the inner section of non-woven fabric, and the coating of whitening agent.

Referring to FIG. 2, inner section of non-woven fabric 16 is coated on a collar facing side 24 with a layer 18 of a whitening agent paste including forty-five percent sursactants, forty-five percent propylene glycol, and three percent proteolytic enzyme. In this embodiment, whitening agent layer 18 is about one millimeter thick. Although a one millimeter whitening agent layer is used in the exemplary embodiment, the whitening agent layer as little as one tenth of a millimeter is sufficient to practice the invention taught herein.

Central barrier strip 14 is constructed from a flexible, moisture impermeable section of plastic sheeting. Referring back to FIG. 1, central barrier strip 14 that is adhesively secured between outer cloth section 12 and inner section of nonwoven fabric 16 in a manner such that whitening agent layer 18 is oriented away from central barrier strip 14. Inner section of nonwoven fabric 16 and barrier strip 14 are the same size. The size of inner section of nonwoven fabric 16 and barrier strip 14 is selected such that adhesive layer 22 extends past inner section of nonwoven fabric 16 and barrier strip 14 a sufficient distance to allow adhesive layer 22 to contact and adhere to the collar material of a shirt.

Figure 3:
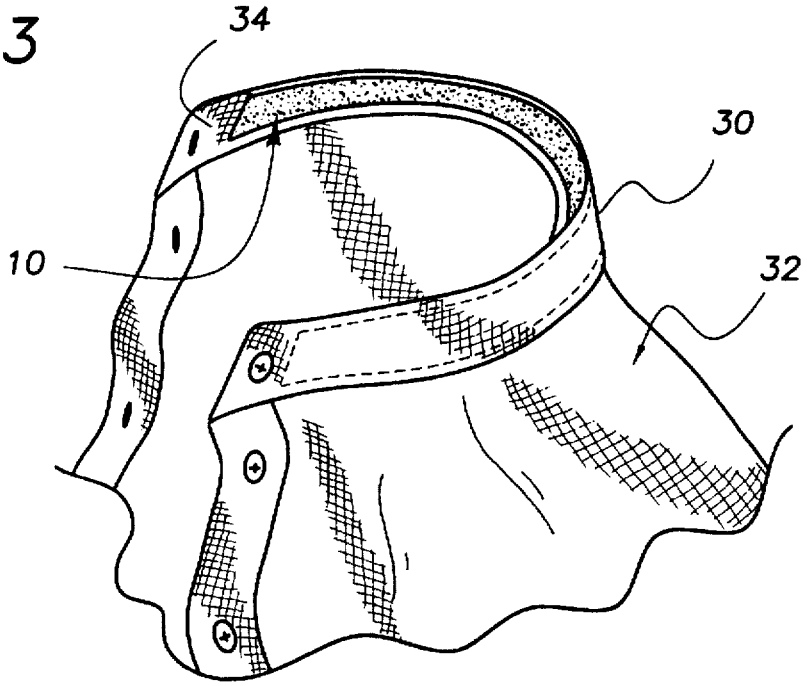
FIG. 3 is a perspective view of the collar shield of FIG. 1 secured to the collar of a representative shirt.

Referring to FIG. 3, in use, collar shield 10 is secured to a collar 30 of a shirt 32 by placing whitening agent layer 18 (shown in FIGS. 1 and 2) against an inside surface 34 of shirt collar 30 and then applying heat, such as with an iron, to activate heat activated adhesive layer 22 and bond collar shield 10 to inside surface 34 of collar 30. As shirt 32 is worn, whitening agent from whitening agent layer 18 is forced into the material of inside surface 34 of shirt collar 30 preventing the formation of stains and remaining during laundering after collar shield 10 has been removed to assist in removal of any stains that have occurred. Collar shield 10 is removed after wearing shirt 32 and prior to laundering by grasping an edge of outer cloth section 12 and pulling collar shield 10 free of shirt collar 30. A new collar shield 10, can be applied to collar 30 when ironing shirt 32 after washing.

It can be seen from the preceding description that a collar shield has been provided that can be placed onto the collar that shields the collar material from contact with the skin of the wearer and that includes a whitening agent that transfers into the collar of the shirt during wear.

It is noted that the embodiment of the collar shield described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A collar shield comprising:

an outer section having a perimeter area of an inwardly facing side thereof coated with a heat activated adhesive layer;

an inner section coated on a collar facing side with a layer of whitening agent; and a central barrier strip formed from a flexible, moisture impermeable material positioned between said outer section and said inner section in a manner such that said layer of whitening agent is oriented away from said central barrier strip;

said outer section, said inner section, and said central barrier strip being secured together with an adhesive to form said collar shield;

said inner section and said central barrier strip being sized such that said heat activated adhesive layer extends past perimeter edges of said inner section and said central barrier strip.

2. The collar shield of claim 1, wherein:

said whitening agent includes a proteolytic enzyme.

3. The collar shield of claim 1, wherein:

said whitening agent is in paste form.

4. The collar shield of claim 3 wherein:

said whitening agent includes a proteolytic enzyme.

5. The collar shield of claim 3 wherein:

said whitening agent includes forty-five percent sursactants, forty-five percent propylene glycol, and three percent proteolytic enzyme.

6. The collar shield of claim 1 wherein:

said outer section is constructed from cloth.

7. The collar shield of claim 1 wherein:

said inner section is constructed from non-woven fabric.

8. The collar shield of claim 1, wherein:

said layer of whitening agent is at least one tenth of one millimeter thick.

9. The collar shield of claim 1, wherein:

said layer of whitening agent is one millimeter thick.

10. The collar shield of claim 3 wherein:

said outer section is constructed from cloth.

11. The collar shield of claim 3 wherein:

said inner section is constructed from non-woven fabric.

12. The collar shield of claim 3, wherein:

said layer of whitening agent is at least one tenth of one millimeter thick.

13. The collar shield of claim 3, wherein:

said layer of whitening agent is one millimeter thick.

14. The collar shield of claim 1 wherein:

said outer section is constructed from cloth; and said whitening agent is in paste form and includes a proteolytic enzyme.

15. The collar shield of claim 14 wherein:

said inner section is constructed from non-woven fabric.

16. The collar shield of claim 15, wherein:

said layer of whitening agent is at least one tenth of one millimeter thick.

17. The collar shield of claim 15, wherein:

said layer of whitening agent is one millimeter thick.

* * * * *